US005100136A

United States Patent [19]

Chen

[11] Patent Number: 5,100,136

[45] Date of Patent: Mar. 31, 1992

[54] STRUCTURE OF RACKET

[76] Inventor: Dennis C. S. Chen, 77 Poai Street, Fengyuan, Taichung County, Taiwan

[21] Appl. No.: 617,166

[22] Filed: Nov. 23, 1990

[51] Int. Cl.[5] ..... A63B 49/02

[52] U.S. Cl. ..... 273/73 R; 273/73 C

[58] Field of Search ..... 273/73 R, 73 C, 73 D, 273/73 E, 73 F, 73 H, 73 K, 73 L

[56] References Cited

U.S. PATENT DOCUMENTS 3,625,512 12/1971 Latham et al. ..... 273/73 C

FOREIGN PATENT DOCUMENTS 0223882 6/1987 European Pat. Off. ..... 273/73 R

*Primary Examiner*—Edward M. Coven

*Assistant Examiner*—Raleigh W. Chiu

[57] ABSTRACT

A racket comprises a head frame having a catgut string threaded therethrough to form a striking surface therein, and a handle extending from the throat portion of the head frame. The head frame has at least one elongate, penetrating aperture formed thereon, with each aperture being separated from the outer periphery thereof by a pair of aligned ribs disposed to either side of the plane of the striking surface to define a receiving space therein. An elongate, elastic element having a generally T-shaped cross-section can be mounted in each receiving space with a central longitudinal protrusion thereon resting between the ribs. The elastic elements serve to adjust the weight and balance of the racket and absorb concomitant shock generated by the impact of a ball with the striking surface.

1 Claim, 3 Drawing Sheets 4-4

4 – 4

STRUCTURE OF RACKET

BACKGROUND OF THE INVENTION

The present invention relates to rackets, and more particularly to a shock absorbing racket provided with T-shaped, detachable, elastic counterweights which can efficiently absorb shock and adjust the weight of the head frame.

Tennis is a ball game very suitable for people of all ages to play indoors as well as outdoors. Either an amateur or a professional player needs to properly adjust the weight distribution of a racket according to his or her physical condition or strength, before playing the game. A regular tennis racket generally does not have any means or structure for adjusting its weight distribution or absorbing the shock waves generated by the impact of a ball. While striking a tennis racket against a ball, shock waves from the striking surface of a tennis racket are directly transmitted through the racket handle to the player's hand causing the player discomfort or numbing sensations in his or her elbows or hands. According to a conventional method, a special clamping device or counter weight is attached to the striking surface of a racket to adjust the weight distribution of a racket and for simultaneously absorbing the shock therein. This method is rather unsatisfactory in use, the disadvantages of which are outlined as follows:

1. Because a clamping device or a counter weight is to be directly attached to the striking surface, it will reduce the total surface area available for striking a ball, and a player will find it difficult to control the hitting direction or the speed of the ball, particularly when a ball directly strikes a clamping device.

2. It requires a special tool to attach a clamping device to the striking surface of a racket or remove it therefrom, and the use of a clamping device may detract from the esthetics of the racket.

SUMMARY OF THE INVENTION

The present invention has been accomplished to eliminate the aforementioned disadvantages of the conventional method of weight adjustment and shock absorbance. The main object of the present invention is to provide a racket with a pair of receiving areas formed on the lateral sides of the headframe thereof, to which elastic weight adjusting and shock absorbing elements can be conveniently mounted or removed.

According to the present invention, a racquet comprises a head frame having a plurality of string holes formed along the outer periphery thereof through which a catgut string is threaded to form a striking surface therein, and a handle extending from the throat portion of the head frame. The head frame has at least one elongate, penetrating aperture formed thereon separated from the outer periphery thereof by a pair of ribs aligned with and disposed to either side of the plane of the striking surface, defining therebetween a receiving space for releasably holding an elastic, weight adjusting and shock absorbing element, having a generally T-shaped cross-section. Each elongate elastic element has a longitudinal protrusion transversely projecting from the centerline thereof which is firmly retained between the two transverse ribs when mounted therein.

BRIEF DESCRIPTION OF THE DRAWINGS

The present invention will now be described by way of example only, with reference to the annexed drawings, in which.

DETAILED DESCRIPTION OF THE PREFERRED EMBODIMENT

Figure 1:
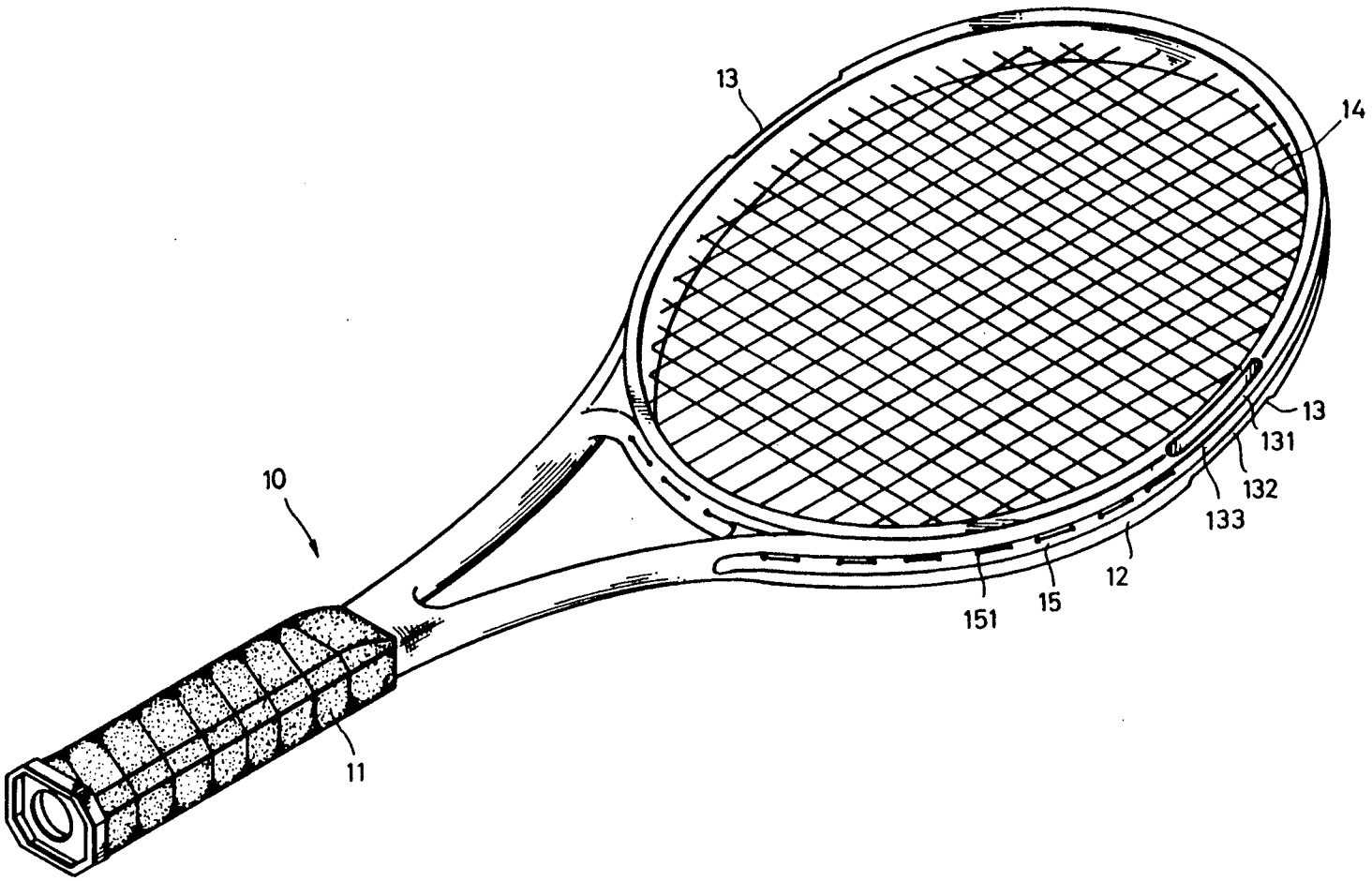
FIG. 1 is a perspective view of a racket embodying the present invention.

Referring to FIG. 1, a tennis racket 10 according to the present invention comprises an oval-shaped headframe 12 having a racket handle 11 extending from the throat portion thereof. An elongate recessed channel 15 is formed along the centerline of the outer periphery of headframe 12. A predetermined number of throughholes 151 are formed along channel 15 of headframe 12 for the threading therethrough of a catgut string 14 to form a striking surface therein.

At least one elongate, penetrating aperture 13 is formed along a portion of headframe 12, spaced a predetermined distance inwards from the outer periphery thereof and extending through the base portion of channel 15 therein. Each aperture 13 thus defines a pair of elongate, aligned ribs, 131 and 132, parallel with and disposed to either side of the plane of the striking surface, and a receiving space 133 between ribs, 131 and 132, and the inner wall thereof.

Figure 2:
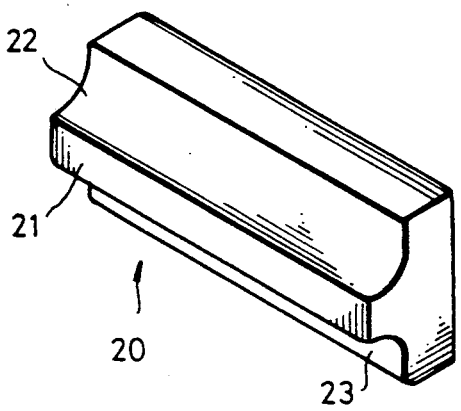
FIG. 2 is a perspective view of the elastic element according to the present invention.

Referring to FIG. 2, each aperture 13 is provided with an elongate, elastic element 20 having a generally T-shaped cross-section. A longitudinal protrusion 21 projects outwardly from one side of each elastic element 20 along the centerline thereof, adjoined respectively on either side thereof by rounded, abutting surfaces, 22 and 23.

Figure 4:
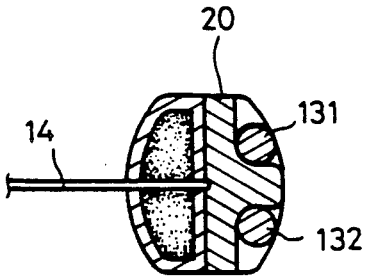
FIG. 4 is a cross-sectional view of FIG. 3 taken along line 4—4.
Figure 3:
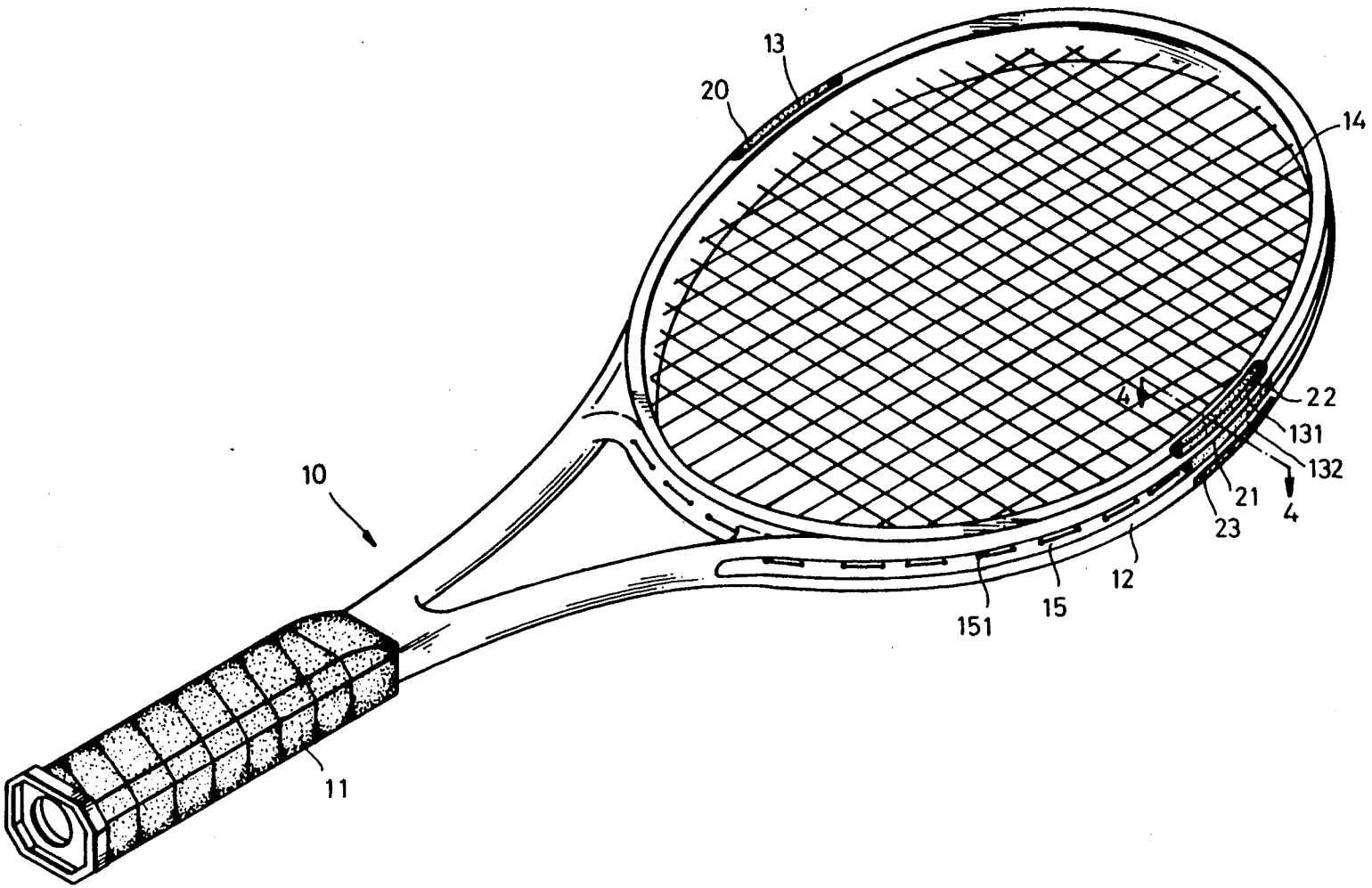
FIG. 3 is a schematic drawing illustrating the embodiment of FIG. 2 in which an elastic element is inserted in the notch.

Each elastic element 20 can be hand inserted through a corresponding aperture 13 and into the receiving space 133 therein, with ribs 131 and 132 containing protrusion 21 therebetween and contacting respective abutting surfaces 22 and 23 to releasably secure elastic element 20 therein, as shown in FIGS. 3 and 4.

Removal of an elastic element 20 can similarly be accomplished by manually manipulating elastic element 20 through a corresponding aperture 13 without the need of extraneous tools.

A user can adjust the weight and balance of racquet 10 by selecting elastic elements 20 of appropriate weight for mounting in corresponding apertures 13 in headframe 12. As elastic elements 20 are in intimate contact with a substantial portion of headframe 12, shock generated therein by the impact of a ball with the striking surface therein is considerably attenuated.

The tennis racket of the present invention thus provides utility to a user in offering a racket whose weight and balance can be quickly and easily adjusted, and which absorbs concomitant shock generated by the impact of a ball therewith to insure a comfortable and non-injurious usage.

Though the description above contains many specificities, these should not be inferred as limitations on the scope of the present invention but merely as one mode of realization of a preferred embodiment thereof. Many variations and modifications would be apparent to one skilled in the art without departing from the spirit or scope of the present invention as defined by the appended claims.

I claim:

1. A tennis racquet comprising a headframe threaded with a string in the conventional manner to form a striking surface therein and a handle portion extending from the throat portion of said headframe, wherein:

at least one elongate, penetrating aperture is formed along a portion of said headframe, being spaced from the outer periphery thereof by a pair of elongate ribs parallel with and disposed to respective sides of the plane of said striking surface, each said aperture and corresponding said ribs define a receiving space therebetween;

an elongate, elastic element, having a generally T shaped cross section with a longitudinal protrusion projecting laterally from the central portion thereof, can be inserted into said receiving space of each said aperture with said protrusion positioned between corresponding said ribs to releasably secure therein.

* * * * *